US008996378B2

(12) United States Patent
Bonada et al.

(10) Patent No.: US 8,996,378 B2
(45) Date of Patent: Mar. 31, 2015

(54) VOICE SYNTHESIS APPARATUS

(75) Inventors: Jordi Bonada, Barcelona (ES); Merlijn Blaauw, Barcelona (ES); Makoto Tachibana, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 13/480,401

(22) Filed: May 24, 2012

(65) Prior Publication Data

US 2012/0310650 A1 Dec. 6, 2012

(30) Foreign Application Priority Data

May 30, 2011 (JP) ..... 2011-120815
May 14, 2012 (JP) ..... 2012-110359

(51) Int. Cl.
*G10L 13/00* (2006.01)
*G10L 13/06* (2013.01)
*G10L 25/93* (2013.01)

(52) U.S. Cl.
CPC *G10L 13/06* (2013.01); *G10L 25/93* (2013.01)
USPC ..... 704/265

(58) Field of Classification Search
CPC ..... G10L 19/06; G10L 19/097; G10L 25/90; G10L 13/07; G10L 13/043; G10L 13/06; G10L 13/04; G06F 3/16; G09B 21/009; H05K 999/99
USPC ..... 704/265, 258, 200, 207, 272, 271
See application file for complete search history.

(56) References Cited

U.S. PATENT DOCUMENTS

| | | | | |
|---|---|---|---|---|
| 6,944,589 | B2 | 9/2005 | Yoshioka et al. | |
| 7,069,217 | B2 * | 6/2006 | McLaughlin et al. | 704/269 |
| 7,529,673 | B2 * | 5/2009 | Makinen et al. | 704/265 |
| 2002/0178006 | A1 | 11/2002 | Suzuki et al. | |
| 2005/0049875 | A1 * | 3/2005 | Kawashima et al. | 704/266 |
| 2009/0063153 | A1 * | 3/2009 | Kapilow et al. | 704/260 |
| 2009/0326950 | A1 * | 12/2009 | Matsumoto | 704/265 |

FOREIGN PATENT DOCUMENTS

| | | |
|---|---|---|
| EP | 0 942 409 A2 | 9/1999 |
| EP | 1 220 194 A2 | 7/2002 |

(Continued)

OTHER PUBLICATIONS

European Search Report mailed Aug. 7, 2013, for EP Patent Application No. 12169235, three pages.

(Continued)

*Primary Examiner* — Jakieda Jackson
(74) *Attorney, Agent, or Firm* — Morrison & Foerster LLP

(57) ABSTRACT

In a voice synthesis apparatus, a phoneme piece interpolator acquires first phoneme piece data corresponding to a first value of sound characteristic, and second phoneme piece data corresponding to a second value of the sound characteristic. The first and second phoneme piece data indicate a spectrum of each frame of a phoneme piece. The phoneme piece interpolator interpolates between each frame of the first phoneme piece data and each frame of the second phoneme piece data so as to create phoneme piece data of the phoneme piece corresponding to a target value of the sound characteristic which is different from either of the first and second values of the sound characteristic. A voice synthesizer generates a voice signal having the target value of the sound characteristic based on the created phoneme piece data.

6 Claims, 6 Drawing Sheets

(56) References Cited

FOREIGN PATENT DOCUMENTS

| | | | |
|---|---|---|---|
| EP | 1 239 457 | A2 | 9/2002 |
| EP | 1 239 463 | A2 | 9/2002 |
| JP | 3-711880 | B2 | 11/2005 |
| JP | 2007-226174 | A | 9/2007 |
| JP | 2010-169889 | A | 8/2010 |

OTHER PUBLICATIONS

European Search Report mailed Dec. 5, 2013, for EP Patent Application No. 12169235, nine pages.

* cited by examiner

VOICE SYNTHESIS APPARATUS

BACKGROUND OF THE INVENTION

1. Technical Field of the Invention

The present invention relates to a technology for interconnecting a plurality of phoneme pieces to synthesize a voice, such as a speech voice or a singing voice.

2. Description of the Related Art

A voice synthesis technology of phoneme piece connection type has been proposed for interconnecting a plurality of phoneme piece data indicating a phoneme piece to synthesize a desired voice. It is preferable for a voice having a desired pitch (height of sound) to be synthesized using phoneme piece data of a phoneme piece pronounced at the pitch; however, it is actually difficult to prepare phoneme piece data with respect to all levels of pitches. For this reason, Japanese Patent Application Publication No. 2010-169889 discloses a construction in which phoneme piece data are prepared with respect to several representative pitches, and a piece of phoneme piece data of a pitch nearest a target pitch is adjusted to the target pitch to synthesize a voice. For example, on the assumption that phoneme piece data are prepared with respect to a pitch E3 and a pitch G3 as shown in FIG. 12, phoneme piece data of a pitch F3 are created by raising the pitch of the phoneme piece data of the pitch E3, and phoneme piece data of a pitch F#3 are created by lowering the pitch of the phoneme piece data of the pitch G3.

In a construction in which an original of phoneme piece data is adjusted to create new phoneme piece data of the target pitch as described in Japanese Patent Application Publication No. 2010-169889, however, a problem is caused that tones of synthesized sounds having pitches adjacent to each other are dissimilar from each other, and therefore, the synthesized sounds are unnatural. For example, a synthesized sound of pitch F3 and a synthesized sound of pitch F#3 are adjacent to each other, and it is natural that tones of the synthesized sounds should be similar to each other. However, original phoneme piece data (pitch E3) constituting a basis of the pitch F3 and original phoneme piece data (pitch G3) constituting a basis of the pitch F#3 are separately pronounced and recorded with the result that the tone of the synthesized sound of the pitch F3 and the tone of the synthesized sound of the pitch F#3 may be unnaturally dissimilar from each other. Particularly in a case in which the synthesized sound of the pitch F3 and the synthesized sound of the pitch F#3 are continuously created, an audience perceives abrupt change of the tone at a transition point of time (a point of time t0 of FIG. 12) at the interface therebetween.

Meanwhile, although the pitch of the phoneme piece data is adjusted in the above description, the same problem may be caused even in a case in which another sound characteristic, such as a sound volume, is adjusted. The present invention has been made in view of the above problems, and it is an object of the present invention to create a synthesized sound having sound characteristic such as a pitch which is different from that of the existing phoneme piece data, using the existing phoneme piece data so that the synthesized sound has a natural tone.

SUMMARY OF THE INVENTION

Means adopted by the present invention so as to solve the above problems will be described. Meanwhile, in the following description, elements of embodiments, which will be described below, corresponding to those of the present invention are shown in parentheses for easy understanding of the present invention; however, the scope of the present invention is not limited to illustration of the embodiments.

A voice synthesis apparatus according to a first aspect of the present invention comprises a phoneme piece interpolation part (for example, a phoneme piece interpolation part 24) that acquires first phoneme piece data (for example, phoneme piece data $V_1$) of a phoneme piece comprising a sequence of frames and corresponding to a first value of sound characteristic (for example, a pitch) and acquires second phoneme piece data (for example, phoneme piece data $V_2$) of the phoneme piece comprising a sequence of frames and corresponding to a second value of the sound characteristic different from the first value of the sound characteristic, the first phoneme piece data and the second phoneme piece data indicating a spectrum of each frame of the phoneme piece, and that interpolates between each frame of the first phoneme piece data and each frame of the second phoneme piece data corresponding to each frame of the first phoneme piece data so as to create phoneme piece data of the phoneme piece corresponding to a target value of the sound characteristic (for example, a target pitch Pt) which is different from the first value and the second value of the sound characteristic; and a voice synthesis part (for example, a voice synthesis part 26) that generates a voice signal having the target value of the sound characteristic based on the phoneme piece data created by the phoneme piece interpolation part.

In the above construction, a plurality of phoneme piece data, values of the sound characteristic of which are different from each other, is interpolated to create phoneme piece data of a target value, and therefore, it is possible to create a synthesized sound having a natural tone as compared with a construction to create phoneme piece data of a target value from a single piece of phoneme piece data.

In a preferred form of the invention, the phoneme piece interpolation part can selectively perform either of a first interpolation process and a second interpolation process. The first interpolation process interpolates between a spectrum of the frame of the first phoneme piece data (for example, the phoneme piece data V1) and a spectrum of the corresponding frame of the second phoneme piece data (for example, the phoneme piece data V2) by an interpolation rate (for example, an interpolation rate $\alpha$) corresponding to the target value of the sound characteristic so as to create the phoneme piece data of the target value. The second interpolation process interpolates between a sound volume (for example, sound volume E) of the frame of the first phoneme piece data and a sound volume of the corresponding frame of the second phoneme piece data by an interpolation rate corresponding to the target value of the sound characteristic, and corrects the spectrum of the frame of the first phoneme piece data based on the interpolated sound volume so as to create the phoneme piece data of the target value.

The intensity of a spectrum of an unvoiced sound is irregularly distributed. In a case in which a spectrum of an unvoiced sound is interpolated, therefore, there is a possibility that a spectrum of a voice after interpolation may be dissimilar from each of phoneme piece data before interpolation. For this reason, an interpolation method for a frame of a voiced sound and an interpolation method for a frame of an unvoiced sound are preferably different from each other.

That is, in a preferred aspect of the present invention, in case that both a frame of the first phoneme piece data and a frame of the second phoneme piece data corresponding to the frame of the first phoneme piece data indicate a voiced sound (namely in case that both the frame of the first phoneme piece data and the frame of the second phoneme piece data corresponding to the frame of the first phoneme piece data on a time axis indicate the voiced sound), the phoneme piece interpolation part interpolates between a spectrum of the frame of the first phoneme piece data and a spectrum of the corresponding frame of the second phoneme piece data by an interpolation rate (for example, an interpolation rate $\alpha$) corresponding to the target value of the sound characteristic.

in case that either of a frame of the first phoneme piece data or a frame of the second phoneme piece data corresponding to the frame of the first phoneme piece data indicates an unvoiced sound (namely in case that either of the frame of the first phoneme piece data and the frame of the second phoneme piece data corresponding to the frame of the first phoneme piece data on a time axis indicates the unvoiced sound), the phoneme piece interpolation part interpolates between a sound volume (for example, sound volume E) of the frame of the first phoneme piece data and a sound volume of the corresponding frame of the second phoneme piece data by an interpolation rate corresponding to the target value of the sound characteristic, and corrects the spectrum of the frame of the first phoneme piece data based on the interpolated sound volume so as to create the phoneme piece data of the target value.

In the above construction, phoneme piece data of the target value are created through interpolation of spectra for a frame in which both of first phoneme piece data and second phoneme piece data correspond to a voiced sound, and phoneme piece data of the target value are created through interpolation of sound volumes for a frame in which either of first phoneme piece data and second phoneme piece data corresponds to an unvoiced sound. Consequently, it is possible to properly create phoneme piece data of the target value even in a case in which a phoneme piece includes both a voiced sound and an unvoiced sound. Meanwhile, sound volumes may be interpolated with respect to the second phoneme piece data. The correction by the sound volume may be applied to the second phoneme piece data instead of the first phoneme piece data.

In a concrete aspect, the first phoneme piece data and the second phoneme piece data comprise a shape parameter (for example, a shape parameter R) indicating characteristics of a shape of the spectrum of each frame of the voiced sound, and the phoneme piece interpolation part interpolates between the shape parameter of the spectrum of the frame of the first phoneme piece data and the shape parameter of the spectrum of the corresponding frame of the second phoneme piece data by the interpolation rate corresponding to the target value of the sound characteristic.

The first phoneme piece data and the second phoneme piece data comprise spectrum data (for example, spectrum data Q) presenting the spectrum of each frame of the unvoiced sound, the phoneme piece interpolation part corrects the spectrum indicated by the spectrum data of the first phoneme piece data based on the sound volume after interpolation to create phoneme piece data of the target value.

In the above aspect, the shape parameter is included in the phoneme piece data with respect to each frame within a section having a voiced sound among the phoneme piece, and therefore, it is possible to reduce data amount of the phoneme piece data as compared with a construction in which spectrum data indicating a spectrum itself are included in the phoneme piece data with respect to even a voiced sound. Also, it is possible to easily and properly create a spectrum in which both the first phoneme piece data and the second phoneme piece data are reflected through interpolation of the shape parameter.

In a preferred aspect of the present invention, for a frame in which the first phoneme piece data or the second phoneme piece data indicates an unvoiced sound, the phoneme piece interpolation part corrects the spectrum indicated by the spectrum data of the first phoneme piece data (or the second phoneme piece data) based on a sound volume after interpolation to create phoneme piece data of the target value. In the above aspect, even for a frame in which the first phoneme piece data or the second phoneme piece data indicates an unvoiced sound (namely, in case that one of the first phoneme piece data and the second phoneme piece data indicates the unvoiced sound and the other of the first phoneme piece data and the second phoneme piece data indicates the voiced sound) in addition to a frame in which both the first phoneme piece data and the second phoneme piece data indicate an unvoiced sound, phoneme piece data of the target value are created through interpolation of the sound volume. Consequently, it is possible to properly create phoneme piece data of the target value even in a case in which a boundary between the voiced sound and the unvoiced sound at the first phoneme piece data is different from the boundary between the voiced sound and the unvoiced sound at the second phoneme piece data. Meanwhile, it is possible to adopt configuration of generating phoneme piece data of the target value by interpolation of the sound volume of the frames in case that one of the first phoneme piece data and the second phoneme piece data indicates the unvoiced sound and the other of the first phoneme piece data and the second phoneme piece data indicates the voiced sound, while interpolation is ignored for the case where both frames of the first phoneme piece data and the second phoneme piece data indicate the unvoiced sound. Meanwhile, a concrete example of the first aspect illustrated above will be described below as, for example, a first embodiment.

As described above, according to one mode of the invention, the voice synthesis apparatus comprises: a phoneme piece interpolation part that interpolates between a spectrum of the frame of the first phoneme piece data and a spectrum of the corresponding frame of the second phoneme piece data by an interpolation rate corresponding to the target value of the sound characteristic in case that both a frame of the first phoneme piece data and a frame of the second phoneme piece data corresponding to the frame of the first phoneme piece data indicate a voiced sound (namely in case that both the frame of the first phoneme piece data and the frame of the second phoneme piece data corresponding to the frame of the first phoneme piece data on a time axis indicate the voice sound); and a voice synthesis part that generates a voice signal having the target value of the sound characteristic based on the phoneme piece data created by the phoneme piece interpolation part.

As described above, according to another mode of the invention, the voice synthesis apparatus comprises: a phoneme piece interpolation part that interpolates between a sound volume of the frame of the first phoneme piece data and a sound volume of the corresponding frame of the second phoneme piece data by an interpolation rate corresponding to the target value of the sound characteristic, in case that either of a frame of the first phoneme piece data or a frame of the second phoneme piece data corresponding to the frame of the first phoneme piece data indicates an unvoiced sound (namely in case that either of the frame of the first phoneme piece data and the frame of the second phoneme piece data corresponding to the frame of the first phoneme piece data on a time axis indicates the unvoiced sound), and that corrects the spectrum of the frame of the first phoneme piece data based on the interpolated sound volume so as to create the phoneme piece data of the target value; and a voice synthesis part that generates a voice signal having the target value of the sound characteristic based on the phoneme piece data created by the phoneme piece interpolation part.

Meanwhile, in a case in which sound characteristics, such as a sound volume, a spectrum envelope, or a voice waveform, of the first phoneme piece data are greatly different from those of the second phoneme piece data, the phoneme piece data created through interpolation of the first phoneme piece data and the second phoneme piece data may be dissimilar from either first phoneme piece data or the second phoneme piece data.

For this reason, in a preferred aspect of the present invention, in case that a difference of sound characteristic between a frame of the first phoneme piece data and a frame of the second phoneme piece data corresponding to the frame of the first phoneme piece data is great (for example, in case that a difference of a sound volume between a frame of the first phoneme piece data and a frame of the second phoneme piece data corresponding to the frame of the first phoneme piece data is greater than a predetermined threshold), the phoneme piece interpolation part creates the phoneme piece data of the target value such as to dominate one of the first phoneme piece data and the second phoneme piece data in the created phoneme piece data over the other of the first phoneme piece data and the second phoneme piece data. Specifically, the phoneme piece interpolation part sets an interpolation rate to be near the maximum value or the minimum value in a case in which the difference of sound characteristics between corresponding frames of the first phoneme piece data and the second phoneme piece data is great (for example, in a case in which an index value indicating the difference therebetween exceeds a threshold value).

In the above aspect, in a case in which the difference of sound characteristics between the first phoneme piece data and the second phoneme piece data is great, the interpolation rate is set so that first phoneme piece data or the second phoneme piece data is given priority, and therefore, it is possible to create phoneme piece data in which the first phoneme piece data or the second phoneme piece data are properly reflected through interpolation. Meanwhile, a concrete example of the aspect described above will be further described below as, for example, a third embodiment.

A voice synthesis apparatus according to a second aspect of the present invention further comprises a continuant sound interpolation part (for example, continuant sound interpolation part 44) that acquires first continuant sound data (for example, continuant sound data S) indicating a first fluctuation component of a continuant sound and corresponding to the first value of the sound characteristic (for example, a pitch) and acquires second continuant sound data indicating a second fluctuation component of the continuant sound and corresponding to the second value of the sound characteristic, and that interpolates between the first continuant sound data and the second continuant sound data so as to create continuant sound data corresponding to the target value (for example, a target pitch Pt), wherein the voice synthesis part (for example, a voice synthesis part 26) creates the voice signal using the phoneme piece data created by the phoneme piece interpolation part and the continuant sound data created by the continuant sound interpolation part.

In the above construction, a plurality of continuant sound data, values of the sound characteristic of which are different from each other, is interpolated to create continuant sound data of the target value, and therefore, it is possible to create a synthesized sound having a natural tone as compared with a construction to create continuant sound data of a target value from a single piece of continuant sound data.

For example, the continuant sound interpolation part extracts a plurality of first unit sections each having a given time length from the first continuant sound data and arranges the first unit sections along a time axis so as to create first intermediate data, extracts a plurality of second unit sections each having a time length equivalent to the time length of the first unit sections from the second continuant sound data and arranges the second unit sections along a time axis so as to create second intermediate data, and interpolates between the first intermediate data and the second intermediate data so as to create the continuant sound data corresponding to the target value of the sound characteristic. Meanwhile, a concrete example of the second aspect illustrated above will be described below as, for example, a second embodiment.

The voice synthesis apparatus according to each aspect described above is realized by hardware (an electronic circuit), such as a digital signal processor (DSP) which is exclusively used to synthesize a voice, and, in addition, is realized by a combination of a general processing unit, such as a central processing unit (CPU), and a program.

A program (for example, a program $P_{GM}$) according to a first aspect of the present invention is executable by the computer for performing a voice synthesis process comprising: acquiring first phoneme piece data of a phoneme piece comprising a sequence of frames and corresponding to a first value of sound characteristic, the first phoneme piece data indicating a spectrum of each frame of the phoneme piece; acquiring second phoneme piece data of the phoneme piece comprising a sequence of frames and corresponding to a second value of the sound characteristic different from the first value of the sound characteristic, the second phoneme piece data indicating a spectrum of each frame of the phoneme piece; interpolating between a spectrum of a frame of the first phoneme piece data and a spectrum of a frame of the second phoneme piece data corresponding to the frame of the first phoneme piece data by an interpolation rate corresponding to a target value of the sound characteristic which is different from the first value and the second value of the sound characteristic so as to create phoneme piece data of the phoneme piece corresponding to the target value, in case that both the frame of the first phoneme piece data and the frame of the second phoneme piece data corresponding to the frame of the first phoneme piece data indicate a voiced sound, and generating a voice signal having the target value of the sound characteristic based on the created phoneme piece data.

Also, a program according to a second aspect of the present invention enables a computer including a phoneme piece storage part for storing phoneme piece data indicating a phoneme piece for different value of a sound characteristic and a continuant sound storage part for storing continuant sound data indicating a fluctuation component of a continuant sound for different value of the sound characteristic, to carry out a continuant sound interpolation process for interpolating a plurality of continuant sound data stored in the continuant sound storage part to create continuant sound data corresponding to the target value and a voice synthesis process for creating a voice signal using the phoneme piece data and the continuant sound data created through the continuant sound interpolation process. The program as described above realizes the same operation and effects as the voice synthesis apparatus according to the present invention. The program according to the present invention is provided to users in a form in which the program is stored in recording media (machine readable storage media) that can be read by a computer so that the program can be installed in the computer, and, in addition, is provided from a server in a form in which the program is distributed via a communication network so that the program can be installed in the computer.

DETAILED DESCRIPTION OF THE INVENTION

A: First Embodiment

Figure 1:
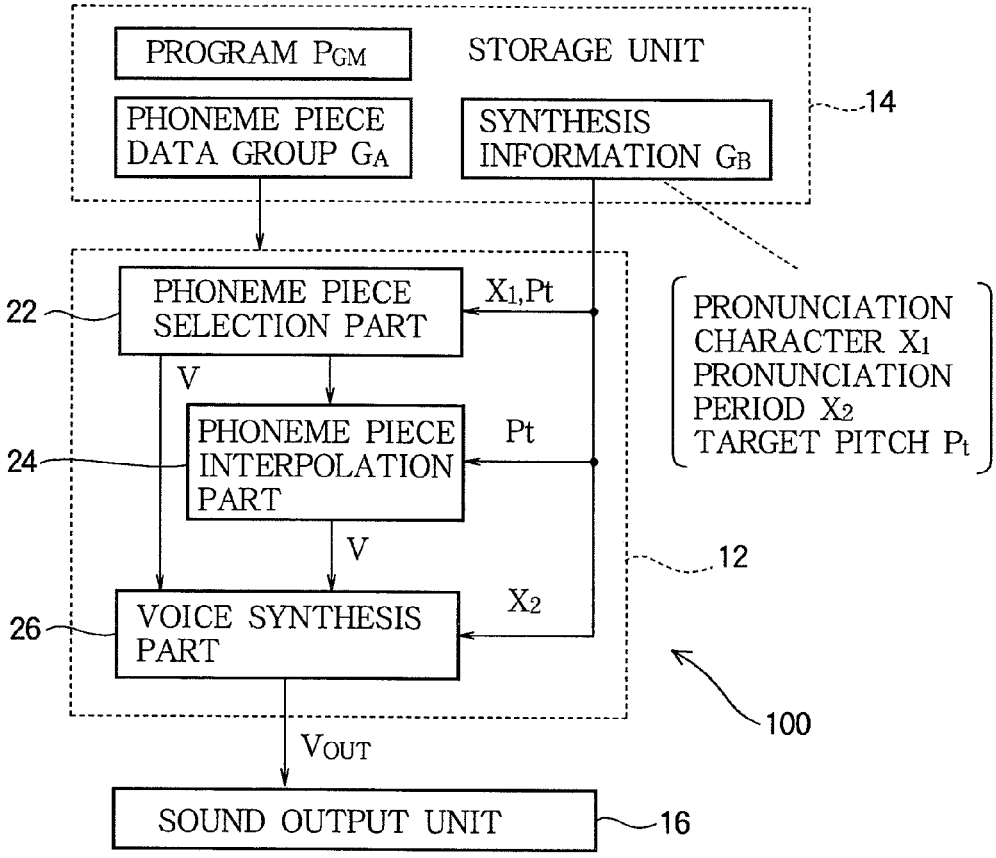
FIG. 1 is a block diagram of a voice synthesis apparatus according to a first embodiment of the present invention.

FIG. 1 is a block diagram of a voice synthesis apparatus 100 according to a first embodiment of the present invention. The voice synthesis apparatus 100 is a signal processing apparatus that creates a voice, such as a speech voice or a singing voice, through a voice synthesis processing of phoneme piece connection type. As shown in FIG. 1, the voice synthesis apparatus 100 is realized by a computer system including a central processing unit 12, a storage unit 14, and a sound output unit 16.

The central processing unit (CPU) 12 executes a program $P_{GM}$ stored in the storage unit 14 to perform a plurality of functions (a phoneme piece selection part 22, a phoneme piece interpolation part 24, and a voice synthesis part 26) for creating a voice signal $V_{OUT}$ indicating the waveform of a synthesized sound. Meanwhile, the respective functions of the central processing unit 12 may be separately realized by integrated circuits, or a detailed electronic circuit, such as a DSP, may realize the respective functions. The sound output unit 16 (for example, a headphone or a speaker) outputs a sound wave corresponding to the voice signal $V_{OUT}$ created by the central processing unit 12.

The storage unit 14 stores the program $P_{GM}$, which is executed by the central processing unit 12, and various kinds of data (phoneme piece data group $G_A$ and synthesis information $G_B$), which are used by the central processing unit 12. Well-known recording media, such as semiconductor recording media or magnetic recording media, or a combination of a plurality of kinds of recording media may be adopted as the machine readable storage unit 14.

Figure 2:
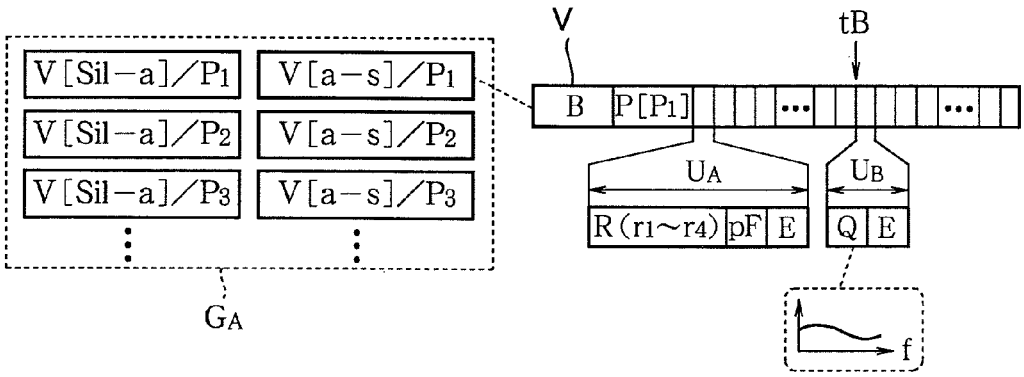
FIG. 2 is a typical presentation of a phoneme piece data group and each phoneme piece data.

As shown in FIG. 2, the phoneme piece data group $G_A$ is a set (voice synthesis library) of a plurality of phoneme piece data V used as material for the voice signal $V_{OUT}$. A plurality of phoneme piece data V corresponding to different pitches P (P1, P2, . . . ) is prerecorded for every phoneme piece and is stored in the storage unit 14. A phoneme piece is a single phoneme equivalent to the minimum linguistic unit of a voice or a series of phonemes (for example, a diphone consisting of two phonemes) in which a plurality of phonemes is connected to each other. In the following, silence will be described as a phoneme (symbol Sil) as one kind of an unvoiced sound for the sake of convenience.

As shown in FIG. 2, phoneme piece data V of a phoneme piece (diphone) consisting of a plurality of phonemes /a/ and /s/ include boundary information B and a pitch P, and a time series of a plurality of unit data U (UA and UB) corresponding to respective frames of the phoneme piece which are divided on a time axis. The boundary information B designates a boundary point tB in a sequence of frames of the phoneme piece. For example, a person who makes the phoneme piece data V sets the boundary point tB while checking a time domain waveform of the phoneme piece so that the boundary point tB accords with each boundary between the respective phonemes constituting the phoneme piece. The pitch P is a total pitch of the phoneme piece (for example, a pitch that is intended by a speaker during recording of the phoneme piece data V).

Each piece of unit data U prescribes a voice spectrum in a frame. A plurality of unit data U of the phoneme piece data V is separated into a plurality of unit data UA corresponding to respective frames in a section including a voiced sound of the phoneme piece and a plurality of unit data UB corresponding to respective frames in a section including an unvoiced sound of the phoneme piece. The boundary point tB is equivalent to a boundary between a series of the unit data UA and a series of the unit data UB. For example, as shown in FIG. 2, phoneme piece data V of a diphone in which a phoneme /s/ of an unvoiced sound follows a phoneme /a/ of a voiced sound include unit data UA corresponding to respective frames of a section (the phoneme /a/ of the voiced sound) in front of the boundary point tB and unit data UB corresponding to respective frames of a section (the phoneme /s/ of the unvoiced sound) at the rear of the boundary point tB. As described above, contents of the unit data UA and contents of the unit data UB are different from each other.

As shown in FIG. 2, a piece of unit data UA of a frame corresponding to a voiced sound includes a shape parameter R, a pitch pF, and a sound volume (energy) E. The pitch pF means a pitch (basic frequency) of a voice in a frame, and the sound volume E means the average of energy of a voice in a frame.

The shape parameter R is information indicating a spectrum (tone) of a voice. The shape parameter includes a plurality of variables indicating shape characteristics of a spectrum envelope of a voice (harmonic component). A first embodiment of the shape parameter R is, for example, an excitation plus resonance (EpR) parameter including an excitation waveform envelope r1, chest resonance r2, vocal tract resonance r3, and a difference spectrum r4. The EpR parameter is created through well-known spectral modeling synthesis (SMS) analysis. Meanwhile, the EpR parameter and the SMS analysis are disclosed, for example, in Japanese Patent No. 3711880 and Japanese Patent Application Publication No. 2007-226174.

The excitation waveform envelope (excitation curve) r1 is a variable approximate to a spectrum envelope of vocal cord vibration. The chest resonance r2 designates a bandwidth, a central frequency, and an amplitude value of a predetermined number of resonances (band pass filters) approximate to chest resonance characteristics. The vocal tract resonance r3 designates a bandwidth, a central frequency, and an amplitude value of each of a plurality of resonances approximate to vocal tract resonance characteristics. The difference spectrum r4 means the difference (error) between a spectrum approximate to the excitation waveform envelope r1, the chest resonance r2 and the vocal tract resonance r3, and a spectrum of a voice.

As shown in FIG. 2, unit data UB of a frame corresponding to an unvoiced sound include spectrum data Q and a sound volume E. The sound volume E means energy of a voice in a frame in the same manner as the sound volume E in the unit data UA. The spectrum data Q are data indicating a spectrum of a voice (non-harmonic component). Specifically, the spectrum data Q include a series of intensities (power and amplitude value) of each of a plurality of frequencies on a frequency axis. That is, the shape parameter R in the unit data UA indirectly expresses a spectrum of a voice (harmonic component), whereas the spectrum data Q in the unit data UB directly express a spectrum of a voice (non-harmonic component).

The synthesis information (score data) $G_B$ stored in the storage unit 14 designates a pronunciation character $X_1$ and a pronunciation period $X_2$ of a synthesized sound and a target value of a pitch (hereinafter, referred to as a 'target pitch') Pt in a time series. The pronunciation character $X_1$ is an alphabet series of song words, for example, in case of synthesizing a singing voice. The pronunciation period $X_2$ is designated, for example, as pronunciation start time and duration. The synthesis information $G_B$ is created, for example, according to user manipulation through various kinds of input equipment, and is then stored in the storage unit 14. Meanwhile, synthesis information $G_B$ received from another communication terminal via a communication network or synthesis information $G_B$ transmitted from a variable recording medium may be used to create the voice signal $V_{OUT}$.

The phoneme selection part 22 of FIG. 1 sequentially selects phoneme piece data V of a phoneme piece corresponding to the pronunciation character $X_1$ of the synthesis information $G_B$ from the phoneme piece data group $G_A$ of the storage unit 14. Phoneme piece data V corresponding to the target pitch Pt are selected among a plurality of phoneme piece data V prepared for each pitch P of the same phoneme piece. Specifically, in a case in which the phoneme piece data V of the pitch P according with the target pitch Pt are stored in the storage unit 14 with respect to the phoneme piece of the pronunciation character $X_1$, the phoneme piece selection part 22 selects the phoneme piece data V from the phoneme piece data group $G_A$. On the other hand, in a case in which the phoneme piece data V of the pitch P according with the target pitch Pt are not stored in the storage unit 14 with respect to the phoneme piece of the pronunciation character $X_1$, the phoneme piece selection part 22 selects a plurality of phoneme piece data V, pitches P of which are near the target pitch Pt, from the phoneme piece data group $G_A$. Specifically, the phoneme piece selection part 22 selects two pieces of phoneme piece data $V_1$ and $V_2$ of different pitches P, between which the target pitch Pt is positioned. That is, phoneme piece data $V_1$ of a pitch P nearest the target pitch Pt and phoneme piece data $V_2$ of another pitch P nearest the target pitch Pt within an opposite range of the pitch P of the phoneme piece data $V_1$ in a state in which the target pitch Pt is positioned between the pitch P of the phoneme piece data $V_1$ and the pitch P of the phoneme piece data $V_2$ are selected.

In a case in which there are no phoneme piece data V of a pitch P according with the target pitch Pt, the phoneme piece interpolation part 24 of FIG. 1 interpolates the two pieces of phoneme piece data $V_1$ and $V_2$ selected by the phoneme piece selection part 22 to create new phoneme piece data V corresponding to the target pitch Pt. The operation of the phoneme piece interpolation part 24 will be described below in detail.

Figure 3:
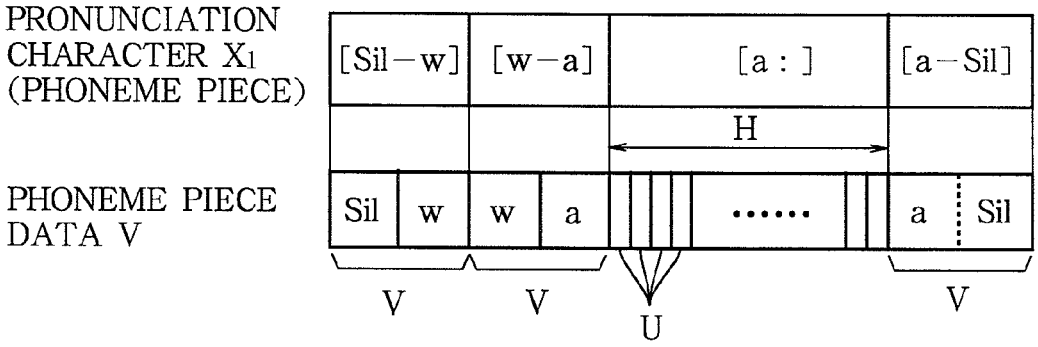
FIG. 3 is a diagram illustrating voice synthesis using phoneme piece data.

The voice synthesis part 26 creates a voice signal $V_{OUT}$ using the phoneme piece data V of the target pitch Pt selected by the phoneme piece selection part 22 and the phoneme piece data V created by the phoneme piece interpolation part 24. Specifically, as shown in FIG. 3, the voice synthesis part 26 decides positions of the respective phoneme piece data V on a time axis based on the pronunciation period $X_2$ (pronunciation start time) designated by the synthesis information $G_B$ and converts a spectrum indicated by each piece of unit data U of the phoneme piece data V into a time domain waveform. Specifically, for the unit data UA, a spectrum specified by the shape parameter R is converted into a time domain waveform and, for the unit data UB, a spectrum directly indicated by the spectrum data Q is converted into a time domain waveform. Also, the voice synthesis part 26 interconnects time domain waveforms created from the phoneme piece data V between the frame in front thereof and the frame at the rear thereof to create a voice signal $V_{OUT}$. As shown in FIG. 3, in a section H in which a phoneme (typically, a voiced sound) is stably continued (hereinafter, referred to as a 'stable pronunciation section'), unit data U of the final frame among phoneme piece data V immediately before the stable pronunciation section are repeated.

Figure 4:
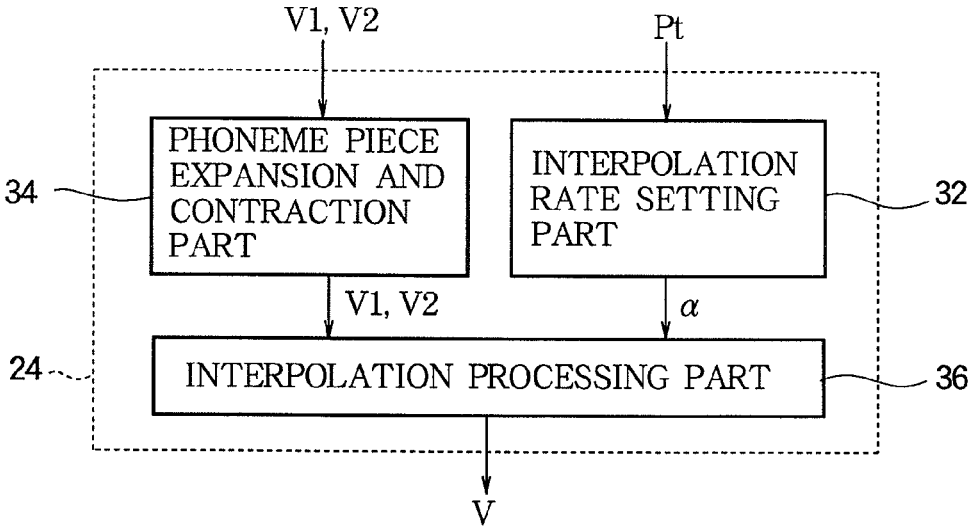
FIG. 4 is a block diagram of a phoneme piece interpolation part.
Figure 5:
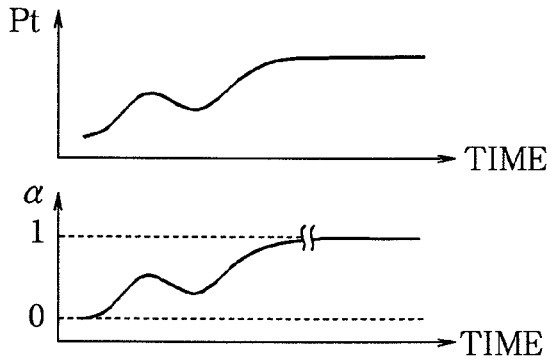
FIG. 5 is a typical view showing time-based change of an interpolation rate.

FIG. 4 is a block diagram of the phoneme piece interpolation part 24. As shown in FIG. 4, a first embodiment of the phoneme piece interpolation part 24 includes an interpolation rate setting part 32, a phoneme piece expansion and contraction part 34, and an interpolation processing part 36. The interpolation rate setting part 32 sequentially sets an interpolation rate $\alpha$ ($0 \leq \alpha \leq 1$) applied to interpolation of the phoneme piece data $V_1$ and the phoneme piece data $V_2$ for every frame based on the target pitch Pt designated by the synthesis information $G_B$ in the time series. Specifically, as shown in FIG. 5, the interpolation rate setting part 32 sets the interpolation rate $\alpha$ for every frame so that the interpolation rate $\alpha$ can be changed within a range between 0 and 1 according to the target pitch Pt. For example, the interpolation rate $\alpha$ is set to a value approximate to 1 as the target pitch Pt approaches the pitch P of the phoneme piece data $V_1$.

Time lengths of a plurality of phoneme piece data V constituting the phoneme piece data group $G_A$ may be different from each other. The phoneme piece expansion and contraction part 34 expands and contracts each piece of phoneme piece data V selected by the phoneme piece selection part 22 so that the phoneme pieces of the phoneme piece data $V_1$ and the phoneme piece data $V_2$ have the same time length (same number of frames). Specifically, the phoneme piece expansion and contraction part 34 expands and contracts the phoneme piece data $V_2$ to the same number M of frames as the phoneme piece data $V_1$. For example, in a case in which the phoneme piece data $V_2$ are longer than the phoneme piece data $V_1$, a plurality of unit data U of the phoneme piece data $V_2$ is thinned out for every predetermined number thereof to adjust the phoneme piece data $V_2$ to the same number M of frames as the phoneme piece data $V_1$. On the other hand, in a case in which the phoneme piece data $V_2$ are shorter than the phoneme piece data $V_1$, a plurality of unit data U of the phoneme piece data $V_2$ is repeated for every predetermined number thereof to adjust the phoneme piece data $V_2$ to the same number M of frames as the phoneme piece data $V_1$.

Figure 6:
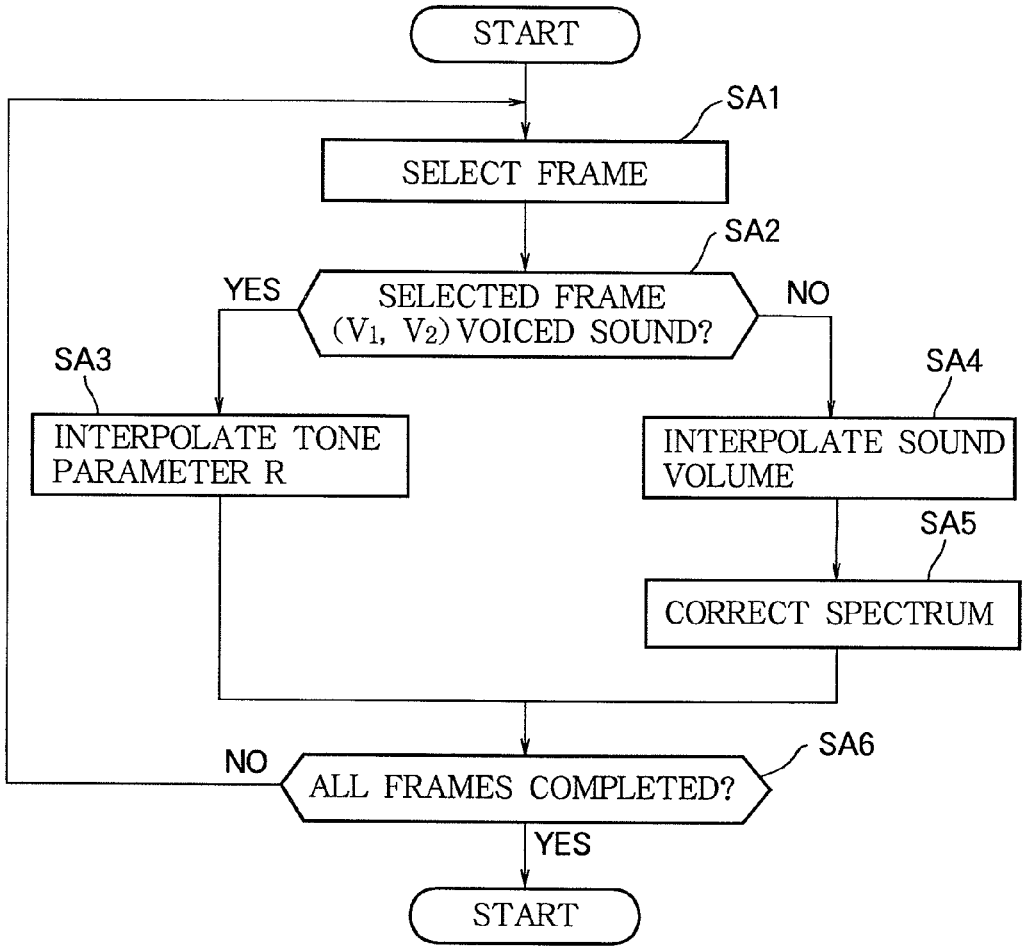
FIG. 6 is a flow chart showing the operation of an interpolation processing part.

The interpolation processing part 36 of FIG. 4 interpolates the phoneme piece data $V_1$ and the phoneme piece data $V_2$ processed by the phoneme piece expansion and contraction part 34 based on the interpolation rate α set by the interpolation rate setting part 32 to create phoneme piece data of the target pitch Pt. FIG. 6 is a flow chart showing the operation of the interpolation processing part 36. The process of FIG. 6 is carried out for each pair of phoneme piece data $V_1$ and phoneme piece data $V_2$ temporally corresponding to each other.

The interpolation processing part 36 selects a frame (hereinafter, referred to as a 'selected frame') from M frames of phoneme piece data V ($V_1$ and $V_2$) (SA1). The respective M frames are sequentially selected one by one whenever step SA1 is carried out, the process (SA1 to SA6) of creating the unit data U (hereinafter, referred to as an 'interpolated unit data Ui') of the target pitch Pt through interpolation is performed for every selected frame. Upon designating the selected frame, the interpolation processing part 36 determines whether the selected frame of both the phoneme piece data $V_1$ and phoneme piece data $V_2$ corresponds to a frame of a voiced sound (hereinafter, referred to as a 'voiced frame') (SA2).

In a case in which the boundary point tB designated by the boundary information B of the phoneme piece data V correctly accords with the boundary of a real phoneme within a phoneme piece (that is, in a case in which distinction between a voiced sound and an unvoiced sound and a distinction between unit data UA and unit data UB correctly correspond to each other), it is possible to determine a frame having prepared unit data UA as a voiced frame and, in addition, to determine a frame having prepared unit data UB as a frame of an unvoiced sound (hereinafter, referred to as an 'unvoiced frame'). However, the boundary point tB between the unit data UA and the unit data UB is manually designated by a person who makes the phoneme piece data V with the result that the boundary point tB between the unit data UA and the unit data UB may be actually different from a boundary between a real voiced sound and a real unvoiced sound in a phoneme piece. Therefore, unit data UA for a voiced sound may be prepared for even a frame actually corresponding to an unvoiced sound, and unit data UB for an unvoiced sound may be prepared even for a frame actually corresponding to a voiced sound. For this reason, at step SA2 of FIG. 6, the interpolation processing part 36 determines a frame having prepared unit data UB as an unvoiced sound and, in addition, determines even a frame having prepared unit data UA as an unvoiced sound if the pitch pF of the unit data UA does not have a significant value (that is, a pitch pF having a proper value is not detected since the frame is an unvoiced sound). That is, a frame in which a pitch pH has a significant value among frames having prepared unit data UA is determined as a voiced frame, and a frame in which, for example, a pitch pH has a value of zero (a value indicating non-detection of a pitch) is determined as an unvoiced frame.

In a case in which the selected frame of both the phoneme piece data $V_1$ and phoneme piece data $V_2$ corresponds to a voiced frame (SA2: YES), the interpolation processing part 36 interpolates a spectrum indicated by the unit data UA of the selected frame among the phoneme piece data $V_1$ and a spectrum indicated by the unit data UA of the selected frame among the phoneme piece data $V_2$ based on the interpolation rate α to create interpolated unit data Ui (SA3). Stated otherwise, the interpolation processing part 36 performs weighted summation of a spectrum indicated by the unit data UA of the selected frame of the phoneme piece data $V_1$ and a spectrum indicated by the unit data UA of the selected frame of the phoneme piece data $V_2$ based on the interpolation rate α to create interpolated unit data Ui (SA3).

For example, the interpolation processing part 36 executes interpolation represented by Expression (1) below with respect to the respective variables x1 (r1 to r4) of the shape parameter R of the selected frame among the phoneme piece data $V_1$ and the respective variables x2 (r1 to r4) of the shape parameter R of the selected frame among the phoneme piece data $V_2$ to calculate the respective variables xi of the shape parameter R of the interpolated unit data Ui.

$$xi=\alpha\cdot x1+(1-\alpha)\cdot x2 \quad (1)$$

That is, in a case in which the selected frame of both the phoneme piece data $V_1$ and phoneme piece data $V_2$ corresponds to a voiced frame, interpolation of spectra (i.e. tones) of a voice is performed to create interpolated unit data Ui including a shape parameter R in the same manner as the unit data UA.

Meanwhile, it is possible to generate an interpolated unit data Ui by interpolating a part of the shape parameter R (r1-r4) while taking numeric values from one of the first phoneme piece data V1 and the second phoneme piece data V2 for the remaining part of the shape parameter R. For example, among various shape parameters R, the interpolation is performed between the first phoneme piece data V1 and the second phoneme piece data V2 for the excitation waveform envelope r1, chest resonance r2 and vocal tract resonance r3. For the remaining difference spectrum r4, a numeric value is selected from one of the first phoneme piece data V1 and the second phoneme piece data V2.

On the other hand, in a case in which the selected frame of the phoneme piece data $V_1$ and/or the phoneme piece data $V_2$ corresponds to an unvoiced frame, interpolation of spectra as in step SA3 cannot be applied since the intensity of a spectrum of an unvoiced sound is irregularly distributed. For this reason, in the first embodiment, in a case in which the selected frame of the phoneme piece data $V_1$ and/or the phoneme piece data $V_2$ corresponds to an unvoiced frame, only a sound volume E of the selected frame is interpolated without performing interpolation of spectra of the selected frame (SA4 and SA5).

For example, in a case in which the selected frame of the phoneme piece data $V_1$ and/or the phoneme piece data $V_2$ corresponds to an unvoiced frame (SA2: NO), the interpolation processing part 36 firstly interpolates a sound volume E1 indicated by the unit data U of the selected frame among the phoneme piece data $V_1$ and a sound volume E2 indicated by the unit data U of the selected frame among the phoneme piece data $V_2$ based on the interpolation rate α to calculate an interpolated sound volume Ei (SA4). The interpolated sound volume Ei is calculated by, for example, Expression (2) below.

$$Ei=\alpha\cdot E1+(1-\alpha)\cdot E2 \quad (2)$$

Secondly, the interpolation processing part 36 corrects a spectrum indicated by the unit data U of the selected frame of the phoneme piece data $V_1$ based on the interpolated sound volume Ei to create interpolated unit data Ui including spectrum data Q of the corrected spectrum (SA5). Specifically, the spectrum of the unit data U is corrected so that the sound volume becomes the interpolated sound volume Ei. In a case in which the unit data U of the selected frame of the phoneme piece data $V_1$ are the unit data UA including the shape parameter R, the spectrum specified from the shape parameter R becomes a target to be corrected based on the interpolated sound volume Ei. In a case in which the unit data U of the selected frame of the phoneme piece data $V_1$ are the unit data UB including the spectrum data Q, the spectrum directly expressed by the spectrum data Q becomes a target to be corrected based on the interpolated sound volume Ei. That is, in a case in which the selected frame of the phoneme piece data $V_1$ and/or the phoneme piece data $V_2$ corresponds to an unvoiced frame, only the sound volume E is interpolated to create interpolated unit data Ui including spectrum data Q in the same manner as the unit data UB.

Upon creating the interpolated unit data Ui of the selected frame, the interpolation processing part 36 determines whether or not the interpolated unit data Ui has been created with respect to all (M) frames (SA6). In a case in which there is an unprocessed frame(s) (SA6: NO), the interpolation processing part 36 selects the frame immediately after the selected frame at the present step as a newly selected frame (SA1) and executes the process from step SA2 to step SA6. In a case in which the process has been performed with respect to all of the frames (SA6: YES), the interpolation processing part 36 ends the process of FIG. 6. Phoneme piece data V including a time series of M interpolated unit data Ui created with respect to the respective frames is used for the voice synthesis part 26 to create a voice signal $V_{OUT}$.

Figure 12:
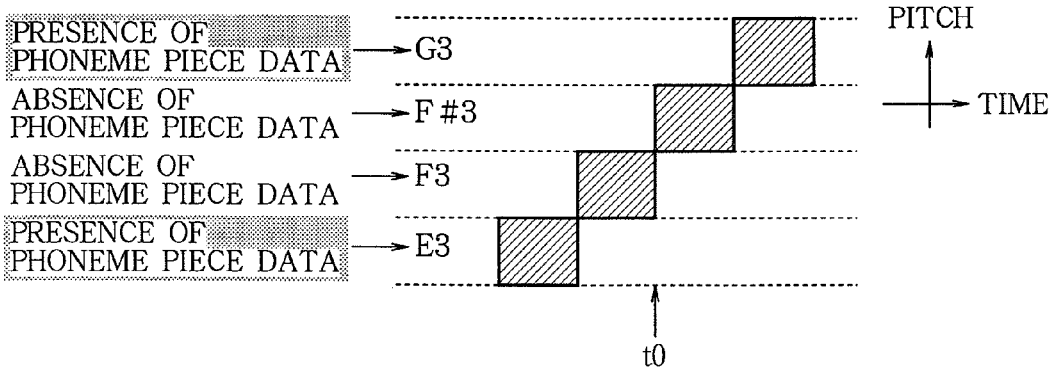
FIG. 12 is a view illustrating adjustment of phoneme piece data according to related art.

As is apparent from the above description, in the first embodiment, a plurality of phoneme piece data V having different pitches P is interpolated (synthesized) to create phoneme piece data V of a target pitch Pt. Consequently, it is possible to create a synthesized sound having a natural tone as compared with a construction in which a single piece of phoneme piece data is adjusted to create phoneme piece data of a target pitch. For example, on the assumption that phoneme piece data V are prepared with respect to a pitch E3 and a pitch G3 as shown in FIG. 12, phoneme piece data V of a pitch F3 and a pitch F#3, which are positioned therebetween, is created through interpolation of the phoneme piece data V of the pitch E3 and the phoneme piece data V of the pitch G3 (however, interpolation rates $\alpha$ thereof are different from each other). Consequently, it is possible to create a synthesized sound of the pitch F3 and the synthesized sound of the pitch F#3 having similar and natural tones with each other.

Also, in a case in which both frames corresponding to each other in terms of time between phoneme piece data $V_1$ and phoneme piece data $V_2$ correspond to a voiced sound, interpolated unit data Ui are created through interpolation of a shape parameter R. On the other hand, in a case in which either or both of frames corresponding to each other in terms of time between the phoneme piece data $V_1$ and the phoneme piece data $V_2$ correspond to an unvoiced sound, interpolated unit data Ui are created through interpolation of sound volumes E. Since an interpolation method for a voiced frame and an interpolation method for an unvoiced frame are different from each other as described above, it is possible to create phoneme piece data which are aurally natural with respect to both of the voiced sound and the unvoiced sound through interpolation, as will be described below in detail.

For example, even in a case in which the selected frame of both the phoneme piece data $V_1$ and phoneme piece data $V_2$ corresponds to a voiced frame, a construction (comparative example 1) in which a spectrum of the phoneme piece data $V_1$ is corrected based on the interpolated sound volume Ei between the phoneme piece data $V_1$ and phoneme piece data $V_2$ may have a possibility that the phoneme piece data V after interpolation may be similar to the tone of the phoneme piece data $V_1$ but may be dissimilar from the tone of the phoneme piece data $V_2$, in the same manner as in a case in which the selected frame corresponds to an unvoiced sound, with the result that the synthesized sound is aurally unnatural. In the first embodiment, in a case in which the selected frame of both the phoneme piece data $V_1$ and phoneme piece data $V_2$ corresponds to a voiced frame, the phoneme piece data V are created through interpolation of the shape parameter R between the phoneme piece data $V_1$ and the phoneme piece data $V_2$, and therefore, it is possible to create a natural synthesized sound as compared with comparative example 1.

Also, even in a case in which the selected frame of the phoneme piece data $V_1$ and/or the phoneme piece data $V_2$ corresponds to an unvoiced frame, a construction (comparative example 2) in which a spectrum of the phoneme piece data $V_1$ and a spectrum of the phoneme piece data $V_2$ are interpolated may have a possibility that a spectrum of the phoneme piece data V after interpolation may be dissimilar from either the phoneme piece data $V_1$ or the phoneme piece data $V_2$, in the same manner as in a case in which the selected frame corresponds to a voiced sound. In the first embodiment, in a case in which the selected frame of the phoneme piece data $V_1$ and/or the phoneme piece data $V_2$ corresponds to an unvoiced frame, a spectrum of the phoneme piece data $V_1$ is corrected based on the interpolated sound volume Ei between the phoneme piece data $V_1$ and phoneme piece data $V_2$, and therefore, it is possible to create a natural synthesized sound in which the phoneme piece data $V_1$ are properly reflected.

B: Second Embodiment

Hereinafter, a second embodiment of the present invention will be described. According to the first embodiment, in a stable pronunciation section H in which a voice which is stably continued (hereinafter, referred to as a 'continuant sound') is synthesized, the final unit data U Of the phoneme piece data V immediately before the stable pronunciation section H is arranged. In the second embodiment, a fluctuation component (for example, a vibrato component) of a continuant sound is added to a time series of a plurality of unit data U in a stable pronunciation section H. Meanwhile, elements of embodiments which will be described below equal in operation or function to those of the first embodiment are denoted by the same reference numerals used in the above description, and a detailed description thereof will be properly omitted.

Figure 7:
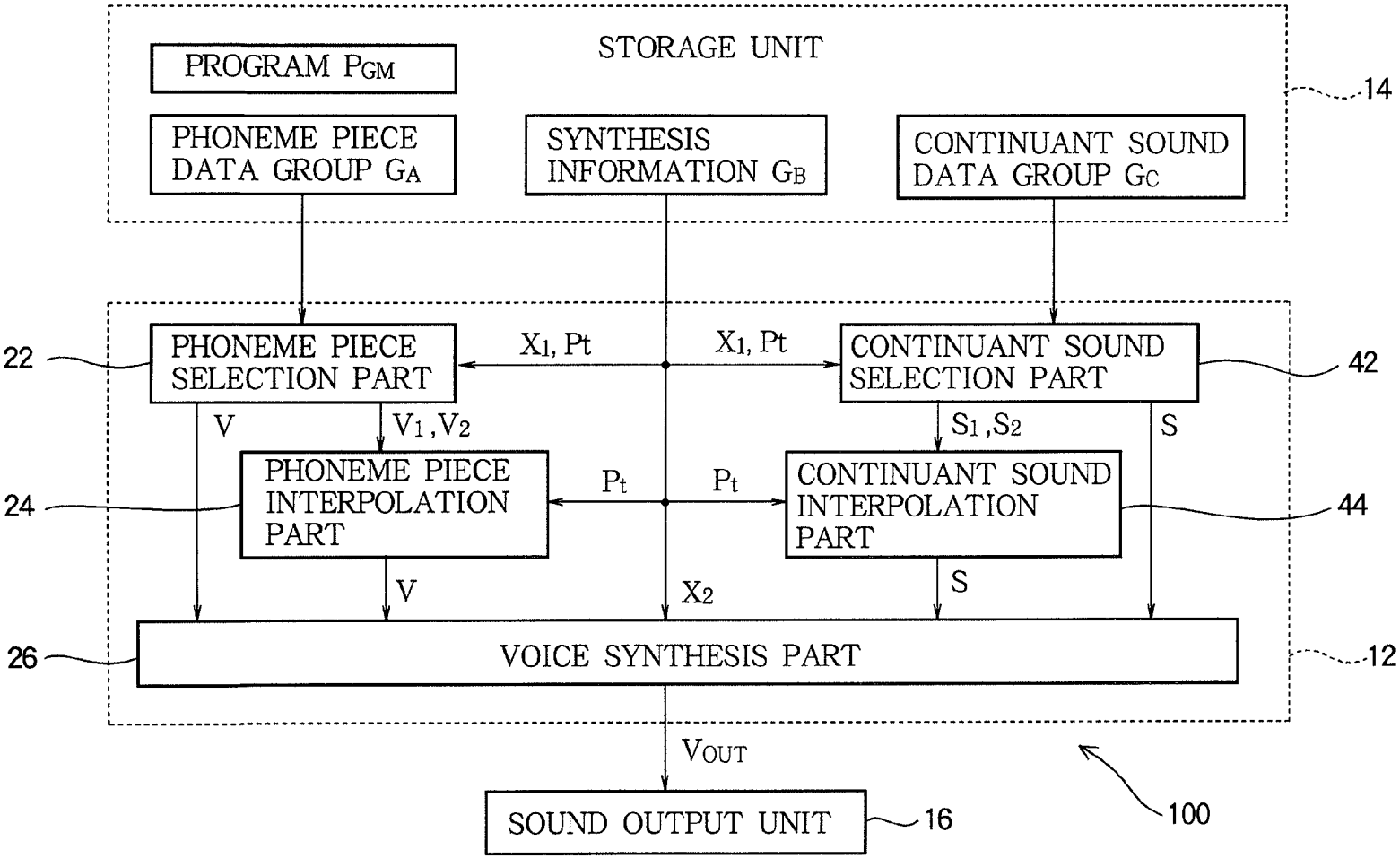
FIG. 7 is a block diagram of a voice synthesis apparatus according to a second embodiment of the present invention.

FIG. 7 is a block diagram of a voice synthesis apparatus 100 according to a second embodiment of the present invention. As shown in FIG. 7, a storage unit 14 of the second embodiment stores a continuant sound data group $G_C$ in addition to a program $P_{GM}$, a phoneme piece data group $G_A$, and synthesis information $G_B$.

Figure 8:
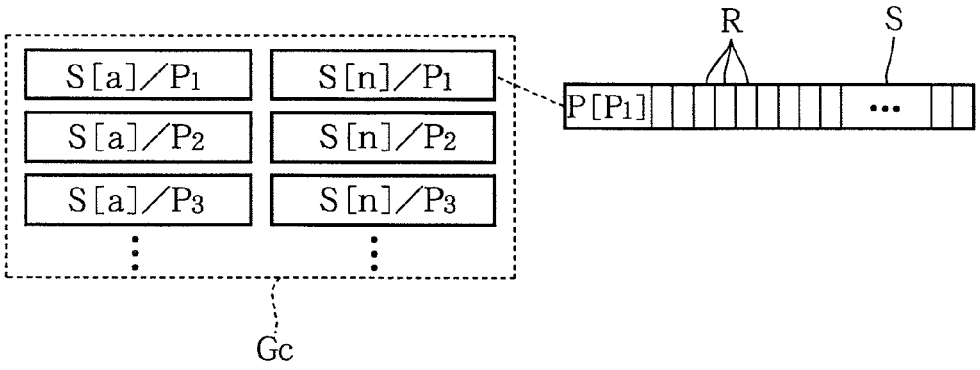
FIG. 8 is a typical presentation of a continuant sound data group and continuant sound data in the voice synthesis apparatus according to the second embodiment of the present invention.

As shown in FIG. 8, the continuant sound data group $G_C$ is a set of a plurality of continuant sound data S indicating a fluctuation component of a continuant sound. The fluctuation component is equivalent to a component which minutely fluctuates along passage of time of a voice (continuant sound) in which acoustic characteristics are stable sustained. As shown in FIG. 8, a plurality of continuant sound data S corresponding to different pitches P (P1, P2, . . . ) is prerecorded for every phoneme piece (every phoneme) of a voiced sound and is stored in the storage unit 14. A piece of continuant sound data S includes a nominal (average) pitch P of the fluctuation component and a time series of a plurality of shape parameters R corresponding to respective frames of the fluctuation component of the continuant sound which are divided on a time axis. Each of the shape parameters R consists of a plurality of variables r1 to r4 indicating characteristics of a spectrum shape of the fluctuation component of the continuant sound.

As shown in FIG. 7, a central processing unit 12 also functions as a continuant sound selection part 42 and a continuant sound interpolation part 44 in addition to the same elements (a phoneme piece selection part 22, a phoneme piece interpolation part 24, and a voice synthesis part 26) as the first embodiment. The continuant sound selection part 42 sequentially selects continuant sound data S for every stable pronunciation section H. Specifically, in a case in which continuant sound data S of a pitch P according with a target pitch Pt of the synthesis information $G_B$ are stored in the storage unit 14 with respect to a phoneme piece of a pronunciation character $X_1$, the continuant sound selection part 42 selects a piece of continuant sound data S from the continuant sound data group $G_C$. On the other hand, in a case in which continuant sound data S of a pitch P according with the target pitch Pt are not stored in the storage unit 14 with respect to the phoneme piece of the pronunciation character $X_1$, the continuant sound selection part 42 selects two pieces of continuant sound data S ($S_1$ and $S_2$) of different pitches P, between which the target pitch Pt is positioned in the same manner as the phoneme piece selection part 22. Specifically, continuant sound data $S_1$ of a pitch P nearest the target pitch Pt and continuant sound data $S_2$ of another pitch P nearest the target pitch Pt within an opposite range of the pitch P of the continuant sound data $S_1$ in a state in which the target pitch Pt is positioned between the pitch P of the continuant sound data $S_1$ and the pitch P of the continuant sound data $S_2$ are selected.

Figure 9:
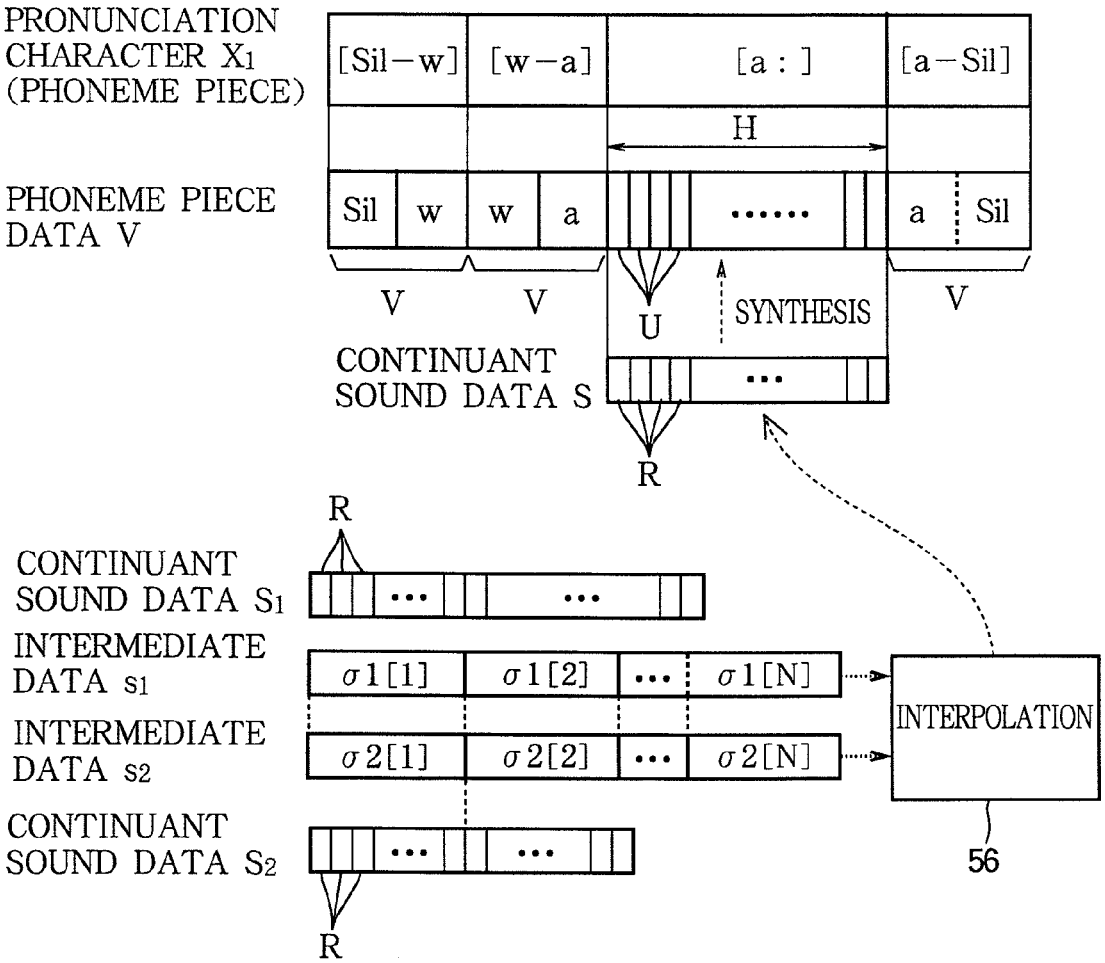
FIG. 9 is a schematic diagram illustrating interpolation of the continuant sound data.

As shown in FIG. 9, the continuant sound interpolation part 44 interpolates two pieces of continuant sound data S ($S_1$ and $S_2$) selected by the continuant sound selection part 42 in a case in which there are no continuant sound data S of a pitch P according with the target pitch Pt to create a piece of continuant sound data S corresponding to the target pitch Pt. The continuant sound data S created through interpolation performed by the continuant sound interpolation part 44 consists of a plurality of shape parameters R corresponding to the respective frames in a stable pronunciation section H based on a pronunciation period $X_2$.

As shown in FIG. 9, the voice synthesis part 26 synthesizes the continuant sound data S of the target pitch Pt selected by the continuant sound selection part 42 or the continuant sound data S created by the continuant sound interpolation part 44 with respect to a time series of a plurality of unit data U in the stable pronunciation section H to create a voice signal $V_{OUT}$. Specifically, the voice synthesis part 26 adds a time domain waveform of a spectrum indicated by each piece of unit data U in the stable pronunciation section H and a time domain waveform of a spectrum indicated by each shape parameter R of the continuant sound data S between corresponding frames to create a voice signal $V_{OUT}$, which is connected between the frame in front thereof and the frame at the rear thereof.

Figure 10:
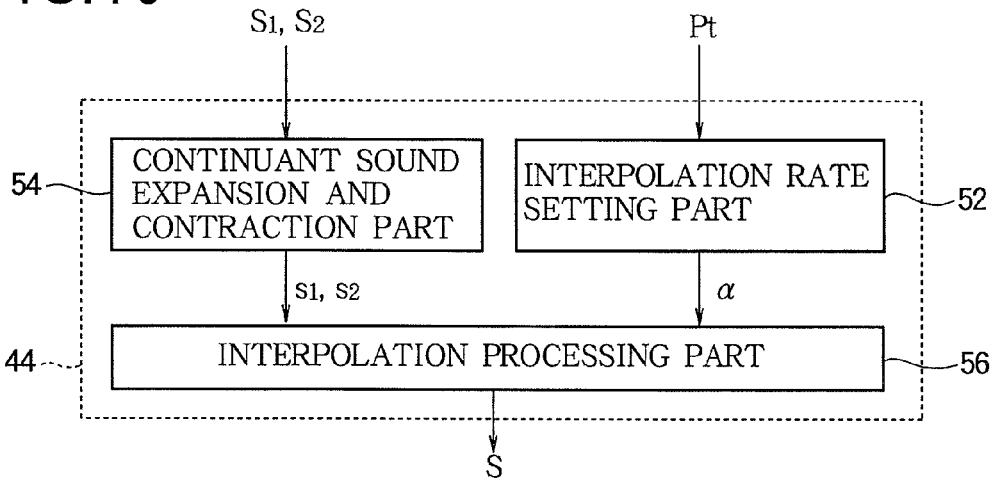
FIG. 10 is a block diagram of a continuant sound interpolation part.

FIG. 10 is a block diagram of the continuant sound interpolation part 44. As shown in FIG. 10, the continuant sound interpolation part 44 includes an interpolation rate setting part 52, a continuant sound expansion and contraction part 54, and an interpolation processing part 56. The interpolation rate setting part 52 sequentially sets an interpolation rate $\alpha$ ($0 \leq \alpha \leq 1$) based on the target pitch Pt for every frame in the same manner as the interpolation rate setting part 32 of the first embodiment. Meanwhile, although the interpolation rate setting part 32 and the interpolation rate setting part 52 are shown as separate elements in FIG. 10 for the sake of convenience, the phoneme piece interpolation part 24 and the continuant sound interpolation part 44 may commonly use the interpolation rate setting part 32.

The continuant sound expansion and contraction part 54 of FIG. 10 expands and contracts the continuant sound data S ($S_1$ and $S_2$) selected by the continuant sound selection part 42 to create intermediate data s ($s_1$ and $s_2$). As shown in FIG. 9, the continuant sound expansion and contraction part 54 extracts and connects N unit sections $\sigma$1[1] to $\sigma$1[N] from a time series of a plurality of shape parameters R of the continuant sound data $S_1$ to create intermediate data $s_1$ in which a number of shape parameters R equivalent to the time length of the stable pronunciation section H are arranged. The N unit sections $\sigma$1[1] to $\sigma$1[N] are extracted from the continuant sound data $S_1$ so that N unit sections $\sigma$1[1] to $\sigma$1[N] can overlap each other on a time axis, and the respective time lengths (the number of frames) are randomly set.

Also, as shown in FIG. 9, the continuant sound expansion and contraction part 54 extracts and connects N unit sections $\sigma$2[1] to $\sigma$2[N] from a time series of a plurality of shape parameters R of the continuant sound data $S_2$ to create intermediate data $s_2$. The time length (the number of frames) of an n-th (n=1 to N) unit section $\sigma$2[n] is set to a time length equal to that of an n-th (n=1 to N) unit section $\sigma$1[n] of the intermediate data $s_1$. Consequently, the intermediate data $s_2$ consists of a number of shape parameters R equivalent to the time length of the stable pronunciation section H in the same manner as the intermediate data $s_1$.

The interpolation processing part 56 of FIG. 10 interpolates the intermediate data $s_1$ and the intermediate data $s_2$ to create continuant sound data S of the target pitch Pt. Specifically, the interpolation processing part 56 interpolates shape parameters R of corresponding frames between the intermediate data $s_1$ and the intermediate data $s_2$ based on the interpolation rate $\alpha$ set by the interpolation rate setting part 52 to create an interpolated shape parameter Ri, and arranges a plurality of interpolated shape parameters Ri in a time series to create continuant sound data S of the target pitch Pt. Expression (1) above is applied to interpolation of the shape parameters R. A time domain waveform of a fluctuation component of a continuant sound specified from the continuant sound data S created by the interpolation processing part 56 is synthesized with a time domain waveform of a voice specified from each piece of unit data U in the stable pronunciation section H to create a voice signal $V_{OUT}$.

The second embodiment also has the same effects as the first embodiment. Also, in the second embodiment, continuant sound data S of the target pitch Pt are created from the existing continuant sound data S, and therefore, it is possible to reduce data amount of the continuant sound data group $G_C$ (capacity of the storage unit 14) as compared with a construction in which continuant sound data S are prepared with respect to all values of the target pitch Pt. Also, a plurality of continuant sound data S is interpolated to create continuant sound data S of the target pitch Pt, and therefore, it is possible to create a natural synthesized sound as compared with a construction to create continuant sound data S of the target pitch Pt from a single piece of continuant sound data S in the same manner as the interpolation of the phoneme piece data V according to the first embodiment.

Meanwhile, a method of expanding and contracting the continuant sound data $S_1$ to the time length of the stable pronunciation section H (thinning out or repetition of the shape parameter R) to create the intermediate data $s_1$ may be adopted as the method of creating the intermediate data $s_1$ equivalent to the time length of the stable pronunciation section H from the continuant sound data $S_1$. In a case in which the continuant sound data $S_1$ are expanded and contracted on a time axis, however, the period of the fluctuation component is changed before and after expansion and contraction with the result that the synthesized sound in the stable pronunciation section H may be aurally unnatural. In the above construction in which the unit sections $\sigma$1[n] extracted from the continuant sound data $S_1$ are arranged to create the intermediate data $s_1$, arrangement of the shape parameters R in the unit section σ1[n] is identical to that of the continuant sound data $S_1$, and therefore, it is possible to create a natural synthesized sound in which the period of the fluctuation component is maintained. The intermediate data $s_2$ are created in the same manner.

C: Third Embodiment

In a case in which a sound volume (energy) of a voice indicated by phoneme piece data $V_1$ is excessively different from that of a voice indicated by phoneme piece data $V_2$ when the phoneme piece data $V_1$ and the phoneme piece data $V_2$ are interpolated, phoneme piece data V having acoustic characteristics dissimilar from either the phoneme piece data $V_1$ or the phoneme piece data $V_2$ may be created with the result that the synthesized sound may be unnatural. In the third embodiment, the interpolation rate α is controlled so that either the phoneme piece data $V_1$ or the phoneme piece data $V_2$ is reflected in interpolation on a priority basis in a case in which the sound volume difference between the phoneme piece data $V_1$ and the phoneme piece data $V_2$ is greater than a predetermined threshold, in consideration of the above problems.

As described above, in case that a difference of sound characteristic between a frame of the first phoneme piece data V1 and a frame of the second phoneme piece data V2 corresponding to the frame of the first phoneme piece data V1 is greater than a predetermined threshold, the phoneme piece interpolation part creates the phoneme piece data of the target value so as to dominate one of the first phoneme piece data and the second phoneme piece data in the created phoneme piece data over the other of the first phoneme piece data and the second phoneme piece data.

Figure 11:
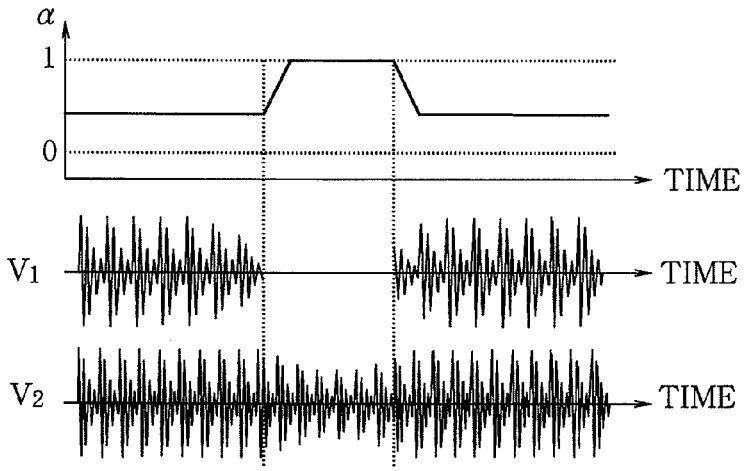
FIG. 11 is a diagram illustrating time-based change of an interpolation rate in a voice synthesis apparatus according to a third embodiment of the present invention.

FIG. 11 is a graph showing time-based change of the interpolation rate α set by the interpolation rate setting part 32. In FIG. 11, waveforms of phoneme pieces respectively indicated by the phoneme piece data $V_1$ and the phoneme piece data $V_2$ are shown along with time-based change of the interpolation rate α on a common time axis. The sound volume of the phoneme piece indicated by the phoneme piece data $V_2$ is almost uniformly maintained, whereas the phoneme piece indicated by the phoneme piece data $V_1$ has a section in which the sound volume of the phoneme piece is lowered to zero.

In a case in which the sound volume difference (energy difference) between corresponding frames of the phoneme piece data $V_1$ and the phoneme piece data $V_2$ is greater than a predetermined threshold as shown in FIG. 11, the interpolation rate setting part 32 of the third embodiment is operated so that the interpolation rate α is near the maximum value 1 or the minimum value 0. For example, the interpolation rate setting part 32 calculates a sound volume difference ΔE (for example, ΔE=E1−E2) between the sound volume E1 designated by the unit data U of the phoneme piece data $V_1$ and the sound volume E2 designated by the unit data U of the phoneme piece data $V_2$ for every frame to determine whether or not the sound volume difference ΔE exceeds a predetermined threshold value. Also, in a case in which frames having the sound volume difference ΔE exceeding the threshold value are continued over a period having a predetermined length, the interpolation rate setting part 32 changes the interpolation rate α to the maximum value 1 over time within the period irrespective of the target pitch Pt. Consequently, the phoneme piece data $V_1$ are applied to the interpolation performed by the interpolation processing part 36 on a priority basis (that is, the interpolation of the phoneme piece data V is stopped). Also, in a case in which frames having the sound volume difference ΔE less than the threshold value are continued over a predetermined period, the interpolation rate setting part 32 changes the interpolation rate α from the maximum value 1 to a value corresponding to the target pitch Pt within the period.

The third embodiment also has the same effects as the first embodiment. In the third embodiment, the interpolation rate α is controlled so that either the phoneme piece data $V_1$ or the phoneme piece data $V_2$ is reflected in interpolation on a priority basis in a case in which the sound volume difference between the phoneme piece data $V_1$ and the phoneme piece data $V_2$ is excessively great. Consequently, it is possible to reduce a possibility that the voice of the phoneme piece data V after interpolation may be dissimilar from either the phoneme piece data $V_1$ or the phoneme piece data $V_2$, and therefore, the synthesized sound is unnatural.

D: Modifications

Each of the above embodiments may be modified in various ways. Hereinafter, concrete modifications will be illustrated. Two or more modifications arbitrarily selected from the following illustration may be appropriately combined.

(1) Although the phoneme piece data V are prepared for every level of the pitch P in each of the above embodiments, it is also possible to prepare the phoneme piece data V for every value of another sound characteristic. The sound characteristic is a concept including various kinds of index values indicating acoustic characteristics of a voice. For example, a variable, such as a sound volume (dynamics) or a expression of a voice may be adopted as the sound characteristic in addition to the pitch P used in the above embodiments. The variable regarding expression of voice includes for example a degree of clearness of voice, a degree of breathing, a degree of mouth opening at voicing and so on. As can be understood from the above illustration, the phoneme piece interpolation part 24 is included as an element which interpolates a plurality of phoneme piece data V corresponding to different values of the sound characteristic to create phoneme piece data V according to a target value (for example, target pitch Pt) of the sound characteristic. The phoneme piece interpolation part 44 of the second embodiment is included as an element which interpolates a plurality of continuant sound data S corresponding to different values of the sound characteristic to create continuant sound data S according to a target value of the sound characteristic, in the same manner as the above.

(2) Although it is determined whether the selected frame is a voiced sound or an unvoiced sound based on the pitch pF of the unit data UA in each of the above embodiments, a method of determining whether the selected frame is a voiced sound or an unvoiced sound may be appropriately changed. For example, in a case in which the boundary between the unit data UA and the unit data UB and the boundary between the voiced sound and the unvoiced sound accord with each other at high precision or the difference therebetween is insignificant, it is also possible to determine whether the selected frame is a voiced sound or an unvoiced sound (unit data UA or unit data UB) based on existence and nonexistence of the shape parameter R. That is, it is also possible to determine that each frame corresponding to the unit data UA including the shape parameter R among the phoneme piece data V is a voiced frame and to determine that each frame corresponding to the unit data UB not including the shape parameter R is an unvoiced frame.

Also, although the unit data UA include the shape parameter R, the pitch pF and the sound volume E, and the unit data UB include the spectrum data Q and the sound volume E in each of the above embodiments, it is also possible to adopt a construction in which all of the unit data U include a shape parameter R, a pitch pF, spectrum data Q and a sound volume E. In an unvoiced frame in which the shape parameter R or the pitch pF cannot be properly detected, the shape parameter R or the pitch pF is set to an abnormal value (for example, a specific value or zero indicating an error). In the above construction, it is possible to determine whether the selected frame is a voiced sound or an unvoiced sound based on whether or not the shape parameter R or the pitch pF has a significant value.

(3) The above described embodiments are not intended to restrict the condition for performing operation of generating the interpolated unit data Ui by interpolation of the shape parameter R and operation of generating the interpolated unit data Ui by interpolation of the sound volume E. For example, regarding frames of a phoneme of a specific type such as voiced consonant sound, it is possible to generate the interpolated unit data Ui by interpolation of the sound volume even if the frames belong to the voiced sound. For frames of phonemes registered in a reference table which is previously prepared, it is possible to generate the interpolated unit data Ui by interpolation of the sound volume E regardless of whether the frames are of voiced sound or unvoiced sound. Further, although frames contained in the phoneme piece data of unvoiced consonant sound generally belong to category of the unvoiced sound, some frames of voiced sound may be mixed in such phoneme piece data. Consequently, it is preferable to generate interpolated unit data Ui by interpolation of the sound volume E for all of the frames of the phoneme piece of the unvoiced consonant sound even if some frame having a voiced sound nature is mixed in the phoneme piece of the unvoiced consonant sound.

(4) The data structure of the phoneme piece data V or the continuant sound data S is optional. For example, although the sound volume E for every frame is included in the unit data U in each of the above embodiments, the sound volume E may not be included in the unit data U but may be calculated from a spectrum indicated by the unit data U (shape parameter R and spectrum data Q) or a time domain waveform thereof. Also, although the time domain waveform is created from the shape parameter R or the spectrum data Q at the time of creating the voice signal $V_{OUT}$ in each of the above embodiments, time domain waveform data for every frame may be included in the phoneme piece data V independently from the shape parameter R or the spectrum data Q, and the time domain waveform data may be used at the time of creating the voice signal V. In a construction in which time domain waveform data is included in the phoneme piece data V, it is not necessary to convert the spectrum indicated by the shape parameter R or the spectrum data Q into a time domain waveform. Also, it is possible to express the shape of a spectrum using other spectrum expression methods, such as line spectral frequencies (LSF), instead of the shape parameter R in each of the above embodiment.

(5) Although the phoneme piece data $V_1$ or the phoneme piece data $V_2$ is given priority in a case in which the sound volume difference between the phoneme piece data $V_1$ and the phoneme piece data $V_2$ is excessively great in the third embodiment, giving priority to the phoneme piece data $V_1$ or the phoneme piece data $V_2$ (that is, stopping of interpolation) is not limited to a case in which the sound volume difference therebetween is great. For example, in a case in which the shapes (formant structures) of spectrum envelopes of a voice indicated by the phoneme piece data $V_1$ and the phoneme piece data $V_2$ are excessively different from each other, a construction in which the phoneme piece data $V_1$ or the phoneme piece data $V_2$ is given priority is adopted. Specifically, in a case in which the shapes of the spectrum envelopes of the phoneme piece data $V_1$ and the phoneme piece data $V_2$ are different from each other insomuch that the formant structure of the voice after interpolation is greatly dissimilar from each piece of phoneme piece data V before interpolation, as in a case in which the voice of one selected from the phoneme piece data $V_1$ and the phoneme piece data $V_2$ has a clear formant structure, whereas the voice of the other selected from the phoneme piece data $V_1$ and the phoneme piece data $V_2$ does not have a clear formant structure (for example, the voice is almost a silent sound), the phoneme piece interpolation part 24 gives priority to the phoneme piece data $V_1$ or the phoneme piece data $V_2$ (that is, stops interpolation). Also, in a case in which the voice waveforms respectively indicated by the phoneme piece data $V_1$ and the phoneme piece data $V_2$ are excessively different from each other, the phoneme piece data $V_1$ or the phoneme piece data $V_2$ may also be given priority. As can be understood from the above illustration, the construction of the third embodiment is included as a construction to set the interpolation rate $\alpha$ to be near the maximum value or the minimum value (that is, to stop interpolation) in a case in which the difference of sound characteristics between corresponding frames of the phoneme piece data $V_1$ and the phoneme piece data $V_2$ is great (for example, in a case in which an index value indicating a degree of difference exceeds a threshold value). The sound volume, the spectrum envelope shape, or the voice waveform as described above is an example of sound characteristics applied to determination.

(6) Although the phoneme piece expansion and contraction part 34 adjusts the phoneme piece data $V_2$ to the number M of frames common to the phoneme piece data $V_1$ through thinning out or repetition of the unit data U in each of the above embodiments, a method of adjusting the phoneme piece data $V_2$ is optional. For example, it is also possible for the phoneme piece data $V_2$ to correspond to the phoneme piece data $V_1$ using technology, such as dynamic programming (DP) matching. The same manner is also applied to the continuant sound data S.

Further, a pair of unit data U adjacent to each other in the phoneme piece data V2 are interpolated on the time axis to expand the phoneme piece data V2. For example, new unit data U is created by interpolation between a second frame and a third frame of the phoneme piece data V2. Then, the interpolation is performed a frame by frame basis between each unit data U of the expanded phoneme piece data V2 and the corresponding unit data U of the phoneme piece data V1. If the time lengths of the respective phoneme piece data stored in the storage unit 14 are identical, there is no need to provide the phoneme piece expansion and contraction part 34 for expanding or contracting respective phoneme piece data V.

Also, although the unit section $\sigma$1[n] is extracted from the time series of the shape parameter R of the continuant sound data $S_1$ in the second embodiment, the time series of the shape parameter R may be expanded and contracted to the time length of the stable pronunciation section H to create intermediate data $s_1$. The same manner is also applied to the continuant sound data $S_2$. For example, in a case in which the time length of the continuant sound data $S_2$ is shorter than that of continuant sound data $S_1$, the continuant sound data $S_2$ may be expanded on a time axis to create intermediate data $s_2$.

(7) Although the interpolation rates a applied to the interpolation of the phoneme piece data V1 and the phoneme interpolation data V2 are varied in the range between 0 and 1 in each of the above embodiments, the variable range of the interpolation rate $\alpha$ can be freely set. For example, an interpolation rate 1.5 may be applied to one of the phoneme piece data V1 and the phoneme piece data V2 and another interpolation rate −0.5 may be applied to the other of the phoneme piece data V1 and the phoneme piece data V2. Such extrapolation operation is also included in the interpolation method of the invention.

(8) Although the storage unit 14 for storing the phoneme piece data group $G_A$ is mounted on the voice synthesis apparatus 100 in each of the above embodiments, there may be another configuration in which an external device (for example, a server device) independent from the voice synthesis apparatus 100 stores the phoneme piece data group $G_A$. In such a case, the voice synthesis apparatus 100 (the phoneme piece selection part 22) acquires the phoneme piece data V from the external device through, for example, communication network so as to generate the voice signal $V_{OUT}$. In similar manner, it is possible to store the synthesis information $G_B$ in an external device independent from the voice synthesis apparatus 100. As understood from the above description, a device such as the aforementioned storage unit 14 for storing the phoneme piece data V and the synthesis information $G_B$ is not an indispensable element of the voice synthesis apparatus 100.

The invention claimed is:

1. A voice synthesis apparatus comprising:

a machine readable storage unit configured to store a plurality of phoneme piece data of a phoneme piece, the plurality of phoneme piece data corresponding to different pitches, each phoneme piece data comprising a plurality of unit data corresponding to respective frames, each unit data including information indicating a spectrum of voice; and circuitry or a general processing unit configured to:

select, from the machine readable storage unit, first phoneme piece data corresponding to a first pitch higher than a target pitch and second phoneme piece data corresponding to a second pitch lower than the target pitch;

determine whether each of a frame of the first phoneme piece data and a frame of the second phoneme piece data corresponding to the frame of the first phoneme piece data indicates a voiced sound or an unvoiced sound;

interpolate between a spectrum of the frame of the first phoneme piece data and a spectrum of the corresponding frame of the second phoneme piece data by an interpolation rate corresponding to the target pitch so as to create phoneme piece data of the phoneme piece corresponding to the target pitch, in case that both the frame of the first phoneme piece data and the corresponding frame of the second phoneme piece data are determined to indicate a voiced sound;

interpolate between a sound volume of the frame of the first phoneme piece data and a sound volume of the corresponding frame of the second phoneme piece data by the interpolation rate, and correct the spectrum of the frame of the first phoneme piece data based on the interpolated sound volume so as to create phoneme piece data of the phoneme piece corresponding to the target pitch, in case that either of the frame of the first phoneme piece data or the corresponding frame of the second phoneme piece data is determined to indicate an unvoiced sound; and generate a voice signal having the target pitch based on the created phoneme piece data.

2. The voice synthesis apparatus according to claim 1, wherein each of a unit data of the first phoneme piece data and a unit data of the second phoneme piece data comprises a shape parameter indicating characteristics of a shape of the spectrum of a respective frame, and wherein the circuitry or the general processing unit is configured to interpolate between the shape parameter of the spectrum of the frame of the first phoneme piece data and the shape parameter of the spectrum of the corresponding frame of the second phoneme piece data by the interpolation rate, in case that both the frame of the first phoneme piece data and the corresponding frame of the second phoneme piece data are determined to indicate a voiced sound.

3. The voice synthesis apparatus according to claim 1, wherein the circuitry or the general processing unit is further configured to:

acquire first continuant sound data indicating a first fluctuation component of a continuant sound and corresponding to the first pitch and acquire second continuant sound data indicating a second fluctuation component of the continuant sound and corresponding to the second pitch;

interpolate between the first continuant sound data and the second continuant sound data so as to create continuant sound data corresponding to the target pitch; and generate the voice signal using the created phoneme piece data and the created continuant sound data.

4. The voice synthesis apparatus according to claim 3, wherein the circuitry or the general processing unit is configured to:

extract a plurality of first unit sections each having a time length from the first continuant sound data and arrange the first unit sections along a time axis so as to create first intermediate data;

extract a plurality of second unit sections each having a time length equivalent to the time length of the first unit sections from the second continuant sound data and arrange the second unit sections along a time axis so as to create second intermediate data; and interpolate between the first intermediate data and the second intermediate data so as to create the continuant sound data corresponding to the target pitch.

5. The voice synthesis apparatus according to claim 1, wherein in case that a difference of sound characteristic between a frame of the first phoneme piece data and a frame of the second phoneme piece data corresponding to the frame of the first phoneme piece data is greater than a predetermined threshold, the circuitry or the general processing unit is configured to set the interpolation rate to be near a maximum value or a minimum value.

6. One or more non-transitory machine readable storage devices for use with or in a voice synthesis apparatus having a general processing unit and a machine readable storage unit configured to store a plurality of phoneme piece data of a phoneme piece, the plurality of phoneme piece data corresponding to different pitches, each phoneme piece data comprising a plurality of unit data corresponding to respective frames, each unit data including information indicating a spectrum of voice, the one or more machine readable storage devices storing program instructions executable by the general processing unit for performing a voice synthesis process comprising:

selecting, from the machine readable storage unit, first phoneme piece data corresponding to a first pitch higher than a target pitch;

selecting, from the machine readable storage unit, second phoneme piece data corresponding to a second pitch lower than the target pitch;

determining whether each of a frame of the first phoneme piece data and a frame of the second phoneme piece data corresponding to the frame of the first phoneme piece data indicates a voiced sound or an unvoiced sound;

interpolating between a spectrum of the frame of the first phoneme piece data and a spectrum of the corresponding frame of the second phoneme piece data by an interpolation rate corresponding to the target pitch so as to create phoneme piece data of the phoneme piece corresponding to the target pitch, in case that both the frame of the first phoneme piece data and the corresponding frame of the second phoneme piece data are determined to indicate a voiced sound;

interpolating between a sound volume of the frame of the first phoneme piece data and a sound volume of the corresponding frame of the second phoneme piece data by the interpolation rate, and correcting the spectrum of the frame of the first phoneme piece data based on the interpolated sound volume so as to create phoneme piece data of the phoneme piece corresponding to the target pitch, in case that either of the frame of the first phoneme piece data or the corresponding frame of the second phoneme piece data is determined to indicate an unvoiced sound; and generating a voice signal having the target pitch based on the created phoneme piece data.

* * * * *